US007814746B2

(12) United States Patent
Aketa et al.

(10) Patent No.: US 7,814,746 B2
(45) Date of Patent: Oct. 19, 2010

(54) EXHAUST DEVICE FOR A DIESEL ENGINE

(75) Inventors: Masahiro Aketa, Osaka (JP); Shuichi Yamada, Osaka (JP); Toshio Nakahira, Osaka (JP); Masahiko Sugimoto, Osaka (JP); Katsushi Inoue, Osaka (JP)

(73) Assignee: Kubota Corporation, Osaka (JP)

( * ) Notice: Subject to any disclaimer, the term of this patent is extended or adjusted under 35 U.S.C. 154(b) by 881 days.

(21) Appl. No.: 11/678,656

(22) Filed: Feb. 26, 2007

(65) Prior Publication Data

US 2008/0202106 A1 Aug. 28, 2008

(51) Int. Cl.
*F01N 3/00* (2006.01)
*F01N 3/10* (2006.01)
*B01D 50/00* (2006.01)

(52) U.S. Cl. ..... 60/295; 60/286; 60/300; 60/303; 422/173; 422/177; 422/182; 422/183

(58) Field of Classification Search ..... 60/286, 60/295, 300, 303; 95/278, 279, 283, 285; 422/173, 174, 177, 183, 182
See application file for complete search history.

(56) References Cited

U.S. PATENT DOCUMENTS 5,826,428 A * 10/1998 Blaschke ..... 60/303
2003/0143442 A1* 7/2003 Daniel et al. ..... 429/17
2005/0150219 A1* 7/2005 Crawley et al. ..... 60/295
2005/0274104 A1* 12/2005 Bromberg et al. ..... 60/275
2006/0075744 A1* 4/2006 Smaling ..... 60/295
2006/0272319 A1* 12/2006 Dettling et al. ..... 60/295

FOREIGN PATENT DOCUMENTS

DE 200 23 560 U1 3/2005
JP 2005-256769 A 9/2005
WO 2007/011113 A1 1/2007

* cited by examiner

*Primary Examiner*—Thomas E Denion
*Assistant Examiner*—Audrey Klasterka
(74) *Attorney, Agent, or Firm*—Panitch Schwarze Belisario & Nadel LLP

(57) ABSTRACT

An exhaust device for a diesel engine supplies liquid fuel (6) from a supply source (5) of the liquid fuel (6) to a gas generator (3) which converts the liquid fuel (6) to flammable gas (7) and from which a flammable-gas supply passage (8) is conducted, the flammable-gas supply passage (8) having a flammable-gas outlet (9) communicated with an exhaust-gas route (1) upstream of a diesel-particulate-filter (2), the flammable gas (7) flowed out of the flammable-gas outlet (9) being burnt in exhaust gas (10) to generate combustion heat which can burn fine particles of the exhaust gas (10) remaining at the filter (2). In this exhaust device for a diesel engine, a case (11) for containing the filter (2) accommodates at least part of the gas generator (3).

13 Claims, 7 Drawing Sheets

EXHAUST DEVICE FOR A DIESEL ENGINE

BACKGROUND OF THE INVENTION

Technical Field

The present invention relates to an exhaust device for a diesel engine and more particularly, concerns an exhaust device for a diesel engine able to make itself compact.

There is an example of the conventional exhaust devices for the diesel engine that supplies liquid fuel from a supply source of liquid fuel to a gas generator, which converts the liquid fuel to flammable gas as well as the present invention. A supply passage of the flammable gas is conducted out of the gas generator. The supply passage of the flammable gas has an outlet of the flammable gas, communicated with an exhaust-gas route upstream of a diesel-particulate-filter. The flammable gas flowed out of the flammable-gas outlet is made to burn in the exhaust gas, thereby generating combustion heat with which the fine particles of the exhaust gas remaining at the filter can be burnt.

The exhaust device of this type has an advantage that even in an operation at a light load where the exhaust gas temperature is low, the combustion heat of the flammable gas raises the temperature of the exhaust gas to be flowed into the filter, thereby burning the fine particles of the exhaust gas to result in being able to recover the filter.

However, the above-mentioned conventional exhaust device has a gas generator separated from a filter-containing case and therefore causes a problem.

The conventional art has the following problem. <Problem> The exhaust device is large-sized.

Since the gas generator is separated from the filter-containing case, the exhaust device is large-sized.

SUMMARY OF THE INVENTION

The present invention has an object to provide an exhaust device for a diesel engine capable of solving the above-mentioned problem and more specifically, an exhaust device for a diesel engine able to make itself compact.

The invention as defined in claim 1 has the following featuring matter.

As exemplified in FIG. 1, an exhaust device for a diesel engine comprises a supply source of liquid fuel 5 which supplies liquid fuel 6 to a gas generator 3. The gas generator 3 converts the liquid fuel 5 to flammable gas 7. There is a flammable-gas supply passage 8 conducted out of the gas generator 3 and having an outlet 9 of the flammable gas 7. The flammable-gas outlet 9 is communicated with an exhaust-gas route 1 upstream of a diesel particulate-filter 2. The flammable gas 7 flowed out of the flammable-gas outlet 9 is burnt in the exhaust gas 10 to generate combustion heat which can burn the fine particles of the exhaust gas residual at the filter 2. In this exhaust device for the diesel engine, a filter-containing case 11 which contains the filter 2 accommodates at least part of the gas generator 3.

(Invention of Claim 1)

<Effect> It is possible to make the exhaust device compact.

As exemplified in FIG. 1, the filter-containing case 11 which contains the filter 2 accommodates at least part of the gas generator 3. Therefore, when compared with the case where the gas generator 3 is separated from the filter-containing case 11, the exhaust device can be made compact.

(Invention of Claim 2)

It offers the following effect in addition to that given by the Invention of claim 1.

<Effect> It is possible to manufacture the exhaust device at a low cost.

As illustrated in FIG. 1, the fuel from a fuel reservoir 5*a* of the diesel engine is used as the liquid fuel 6. When mixing the liquid fuel 6 with air 44, employed as this air 44 is the air from a supercharger 39. Accordingly, the fuel reservoir 5*a* and the supercharger 39 of the diesel engine with the supercharger 39 can serve as the fuel supply source and the air supply source of the gas generator 3, respectively to result in being able to manufacture the exhaust device at a low cost.

(Invention of Claim 3)

It offers the following effect in addition to that presented by the Invention as set forth in Claim 1 or Claim 2.

<Effect> Gas is highly efficiently generated in a catalyst chamber.

As exemplified in FIG. 2(A), a catalyst chamber 51 has an upper portion where a heat-conduction plate 52 is arranged. There is formed a fuel-passing gap 53 along an upper surface of the heat-conduction plate 52. The fuel-passing gap 53 has a peripheral edge opened to provide a fuel outlet 54 to the catalyst chamber 51. The catalytic combustion heat generated in the catalyst chamber 51 is conducted to the fuel-passage gap 53 through the heat-conduction plate 52. Thus the liquid fuel 6 and the air 44 are pre-heated within the fuel-passing gap 53 ahead of the catalyst chamber 51 to result in accelerating the vaporization of the liquid fuel 6 and feeding homogeneous mixture of air and fuel to the catalyst chamber 51, thereby enhancing the efficiency of gas generation in the catalyst chamber 51.

<Effect> The heat-conduction plate is heated at a low cost.

As exemplified in FIG. 2(A), the catalytic combustion heat generated in the catalyst chamber 51 is conducted through the heat-conduction plate 52 to the fuel-passing gap 53. Consequently, while the catalytic combustion heat is generating, it is unnecessary to heat the heat-conduction plate 52 by a glow plug 45 or the like with the result of heating the heat-conduction plate 52 at a low cost.

(Invention of Claim 4)

It offers the following effect in addition to that of the Invention as set forth in Claim 3.

<Effect> It is possible to effect the commencement of gas generation promptly.

As illustrated in FIG. 2(A), the liquid fuel 6 flowed out of the fuel outlet 54 is received by a peripheral edge portion 56*a* of a guide plate 56 and is guided by the guide plate 56 so as to approach an exothermic portion 45*a* of the glow plug 45. Therefore, by making the glow plug 45 exothermic at the time of the commencement of gas generation before the catalytic combustion heat is generated in the catalyst chamber 51, without the catalytic combustion heat, the liquid fuel 6 flowed out of the fuel outlet 54 approaches the exothermic portion 45*a* of the glow plug 45 through the guidance of the guide plate 56 and is pre-heated ahead of the catalyst chamber 51. This accelerates the vaporization of the liquid fuel 6, introduces a homogeneous mixture of air and fuel into the catalyst chamber 51 and activates a catalyst 51*a* with the heat of the glow plug 45 to result in promptly effecting the commencement of the gas generation.

(Invention of Claim 5)

It offers the following effect in addition to that presented by Claim 4. <Effect> It is possible to perform the commencement of gas generation promptly.

As exemplified in FIG. 2(A), a flame-quenching material 57 is filled into a space between the heat-conduction plate 52 and the guide plate 56. When the glow plug 45 is made exothermic, the heat of this exothermic glow plug 45 is conducted through the flame-quenching material 57 to the heat conduction-plate 52 and the guide plate 56. Thus by making the glow plug 45 exothermic at the time of commencement of gas generation before the catalytic combustion heat is generated in the catalyst chamber 51, without the catalytic combustion heat, the liquid fuel 6 and the air 44 are pre-heated while they are passing through the fuel-passing gap 53 and the flame-quenching material 57 ahead of the catalyst chamber 51 and the liquid fuel 6 flowed out of the fuel-passing gap 53 is pre-heated while it is guided by the guide plate 56. This leads to the acceleration of the vaporization of the liquid fuel 6 and the introduction of homogeneous mixture of air and fuel to the catalyst chamber 51 with the result of being able to promptly perform the commencement of gas generation.

<Effect> The gas is highly efficiently generated in the catalyst chamber.

As exemplified in FIG. 2(A), the flame-quenching material 57 is filled into the space between the heat-conduction plate 52 and the guide plate 56. While the catalyst is burning in the catalyst chamber 51, the catalytic combustion heat is conducted through the guide plate 56 and the flame-quenching material 57 to the heat-conduction plate 52. The liquid fuel 6 and the air 44 are pre-heated while they are passing through the fuel-passing gap 53 and the flame-quenching material 57 ahead of the catalyst chamber 51. This accelerates the vaporization of the liquid fuel 6 and the introduction of homogeneous mixture of air and fuel to the catalyst chamber 51 to result in improving the efficiency of gas generation in the catalyst chamber 51.

<Effect> It is possible to inhibit the heat-damage of the gas generator by flame-combustion.

As shown in FIG. 2(A), the flame-quenching material 57 is filled into the space between the heat-conduction plate 52 and the guide plate 56. Owing to the quenching function of the flame-quenching material 57, it inhibits the occurrence of the flame-combustion between the heat-conduction plate 52 and the guide plate 56 and can prevent the heat-damage of the gas generator caused by the flame-combustion.

(Invention of Claim 6)

It offers the following effect in addition to that of the Invention as set forth in Claim 5.

<Effect> The gas is generated highly efficiently in the catalyst chamber.

As exemplified in FIG. 2(A), the guide plate 56 has an under surface brought into contact with a catalyst 51*a* within the catalyst chamber 51. While the catalyst 51*a* is burning in the catalyst chamber 51, the catalytic combustion heat is efficiently conducted to the guide plate 56 as well as to the flame-quenching material 57 and the heat-conduction plate 52. Thus the liquid fuel 6 and the air 44 are efficiently pre-heated while they are passing through the flame-quenching material 57 and the fuel-passing gap 53 ahead of the catalyst chamber 51 to entail a high efficiency of the gas generation in the catalyst chamber 51.

(Invention of Claim 7)

It offers the following effect in addition to that given by the Invention as set forth in Claim 5 or Claim 6.

<Effect> Gas is generated within the catalyst chamber with an increased efficiency.

Since a catalyst component is supported on the flame-quenching material 57, part of the liquid fuel 6 makes a catalytic combustion while the liquid fuel 6 is passing through the flame-quenching material 57 before the catalyst chamber 51 to produce heat with which the liquid fuel 6 is pre-heated. This accelerates the vaporization of the liquid fuel 6 and introduces homogeneous mixture of air and fuel into the catalyst chamber 51 to result in the high efficiency of gas generation in the catalyst chamber 51.

(Invention of Claim 8)

It offers the following effect in addition to that presented by the Invention as defined by any one of Claims 4 to 7.

<Effect> It is possible to perform the commencement of the gas generation promptly.

As exemplified in FIG. 2(A), when the glow plug 45 is made exothermic, the heat of this glow plug 45 is conducted through the heat-conduction plate 52 to the fuel-passing gap 53. By making the glow plug 45 exothermic at the time of commencement of gas generation before the catalytic combustion occurs in the catalyst chamber 51, without the catalytic combustion heat, the liquid fuel 6 and the air 44 are pre-heated while they are passing through the fuel-passing gap 53 ahead of the catalyst chamber 51. This entails acceleration of the vaporization of the liquid fuel 6 and introduction of homogeneous mixture of air and fuel into the catalyst chamber 51 with the result of prompt commencement of gas generation.

(Invention of Claim 9)

It offers the following effect in addition to that given by any one of the Inventions as set forth in Claims 1 to 8.

<Effect> Even if the exhaust gas has a low temperature, it can burn the flammable gas.

As exemplified in FIG. 1, an oxidation catalyst 12 for accelerating the combustion of the flammable gas 7 is disposed between the flammable-gas outlet 9 and an inlet 2*a* of the filter 2. Thus even if the exhaust gas 10 has a low temperature, it can burn the flammable gas 7.

(Invention of Claim 10)

It offers the following effect in addition to that of the Invention as set forth in Claim 9.

<Effect> Even if the exhaust gas has a low temperature, it can burn the flammable gas.

As exemplified in FIG. 3, in order to flow the flammable gas 7 heated by the exothermic reaction within the gas generator 3 from the flammable-gas outlet 9 to the oxidation catalyst 12, the oxidation catalyst 12 is filled into a case 65 for accommodating the oxidation catalyst 12 and the flammable-gas outlet 9 is opened into the oxidation catalyst 12. The oxidation-catalyst accommodating case 65 has a peripheral wall 66 provided with a plurality of exhaust gas inlets 67 and has a terminal end portion 68 provided with an exhaust gas outlet 69. Therefore, it is possible to reduce the flow-in amount of the exhaust gas per unit area of each of the exhaust gas inlets 67 in proportion to the possible increase of the total opening area of the exhaust gas inlets 67. Owing to this arrangement, even in the case where the exhaust gas has a low temperature, the mixture of the flammable gas 7 and the exhaust gas 10 passes through the oxidation catalyst 12 while it is retaining a relatively high temperature to secure an activation temperature of the oxidation catalyst 12 with the result of burning the flammable gas 7. This burning heat increases the temperature of the exhaust gas 10, which in turn can burn the fine particles of the exhaust gas at the filter 12.

(Invention of Claim 11)

It offers the following effect in addition to that afforded by the Invention as defined in Claim 10.

<Effect> It is possible to alleviate the resistance the exhaust gas undergoes when it passes through the oxidation catalyst.

As shown in FIG. 3, when arranging the exhaust gas inlets 67 in parallel with one another in the peripheral wall 66 of the oxidation-catalyst accommodating case 65 from a beginning end portion 70 of the case 65 to a terminal end portion 68 thereof, the oxidation-catalyst accommodating case 65 has the peripheral wall 66 progressively increased in diameter from the beginning end portion 70 to the terminal end portion 68. Accordingly, it is possible to progressively augment a sectional area of the passage of the oxidation catalyst 12 in compliance with the passage amount of the exhaust gas increasing as it approaches the terminal end portion 68 from the beginning end portion 70 of the oxidation-catalyst accommodating case 65 and as a result to decrease the resistance that the exhaust gas 10 encounters when it passes through the oxidation catalyst 12.

(Invention of Claim 12)

It offers the following effect in addition to that given by any one of the Inventions as set forth in Claims 9 to 11.

<Effect> It is possible to prevent the damage the oxidation catalyst undergoes when it burns.

Used as the oxidation catalyst 12 is a catalyst which comprises a catalyst component supported on a metal substrate of a cubic mesh-structure. The quenching function of the substrate inhibits the flame-combustion within the oxidation catalyst 12 with the result of being able to prevent the damage the oxidation catalyst experiences when it burns.

(Invention of Claim 13)

It offers the following effect in addition to that afforded by the Invention as set forth in any one of Claims 9 to 12.

<Effect> The exhaust device can be made compact.

As exemplified in FIG. 1, the oxidation catalyst 12 and at least part of the gas generator 3 are arranged within the exhaust-gas inlet pipe 21 of the filter-containing case 11, which results in the possibility of making the exhaust device compact.

<Effect> It is possible to reduce the dimension of the filter-containing case in a front and rear direction.

As exemplified in FIG. 1, when an axial direction of the filter-containing case 11 is taken as a front and rear direction, the exhaust-gas inlet pipe 21 is inserted into an exhaust gas-inlet chamber 19 along a radial direction of the filter-containing case 11, and the oxidation catalyst 12 and at least part of the gas generator 3 are arranged in the mentioned order within the exhaust-gas inlet pipe 21 from an upstream side. This arrangement can decrease the front and rear dimension of the filter-containing case 11.

<Effect> The oxidation catalyst and the gas generator are hardly damaged.

As exemplified in FIG. 1, the exhaust-gas inlet pipe 21 is inserted into the exhaust gas inlet chamber 19 along the radial direction of the filter-containing case 11, and the oxidation catalyst 12 and at least part of the gas generator 3 are arranged within the exhaust-gas inlet pipe 21. The oxidation catalyst 12 is protected doubly by a wall of the filter-containing case 11 and a wall of the exhaust gas inlet pipe 21 as well as the at least part of the gas generator 3 to result in hardly damaging the oxidation catalyst 12 and the gas generator 3.

<Effect> Even the exhaust gas of a low temperature can secure the activation temperature of the oxidation catalyst.

As exemplified in FIG. 1, the exhaust-gas inlet pipe 21 is inserted into the exhaust-gas inlet chamber 19 along the radial direction of the filter-containing case 11 and the oxidation catalyst 12 is disposed within the exhaust gas inlet pipe 21. Thus the oxidation catalyst 12 is surrounded doubly by the wall of the exhaust-gas inlet pipe 21 and the wall of the filter-containing case 11 so that the heat of the oxidation catalyst 12 hardly escapes. For this reason, even the exhaust gas of a low temperature can secure the activation temperature of the oxidation catalyst 12.

<Effect> A pipe for conducting out the flammable gas is hardly damaged.

As exemplified in FIG. 1(A), the exhaust-gas inlet pipe 21 is inserted into the exhaust-gas inlet chamber 19 along the radial direction of the filter-containing case 11, and the oxidation catalyst 12 and at least part of the gas generator 3 are arranged in the mentioned order within the exhaust-gas inlet pipe 21 from the upstream side. Further, a flammable-gas supply passage 8 conducted out of the gas generator 3 is inserted into the oxidation catalyst 12. Therefore, the flammable-gas supply passage 8 is protected by the wall of the filter-containing case 11, the wall of the exhaust-gas inlet pipe 21 and the oxidation catalyst 12 to thereby hardly damage the flammable-gas supply passage 8.

(Invention of Claim 14)

It offers the following effect in addition to that presented by the Invention as set forth in Claim 13.

<Effect> The exhaust device can be made compact.

As illustrated in FIG. 1, since an exhaust muffler 28 is employed as the filter-containing case 11, there is no need of preparing the filter-containing case 11 and the exhaust muffler 28 independently with the result of being able to make the exhaust device compact.

(Invention of Claim 15)

It offers the following effect in addition to that afforded by the Invention as defined by any one of Claims 1 to 14.

<Effect> The combustion heat of the flammable gas is stably obtained.

The gas generator 3 vaporizes the liquid fuel 6 to covert this liquid fuel 6 into the flammable gas 7. Thus when compared with a reaction such as partial oxidation, there is less fluctuation of the component ratio of the flammable gas 7 to bring forth the attainment of stable combustion heat of the flammable gas 7.

(Invention of Claim 16)

It offers the following effect in addition to that presented by the Invention as set forth in any one of Claims 1 to 14.

<Effect> Even the exhaust gas of a low temperature can burn the flammable gas.

The gas generator 3 partially oxidizes the liquid fuel 6 to convert the liquid fuel 6 into the flammable gas 7 containing carbon monoxide and hydrogen. Accordingly, the flammable gas 7 ignites at a relatively low temperature and therefore can be burnt even if the exhaust gas 10 has a low temperature.

(Invention of Claim 17)

It offers the following effect in addition to that given by the Invention of Claim 9.

<Effect> Even the exhaust gas of a low temperature can secure the activation temperature of the oxidation catalyst.

As illustrated in FIGS. 4 and 7, in order to flow the flammable gas 7 heated by the exothermic reaction within the gas generator 3, from the flammable-gas outlet 9 to the upstream of the oxidation catalyst 12, an upstream oxidation-passage 14 is formed within the exhaust-gas passage 13 upstream of the oxidation catalyst 12 to form the exhaust-gas passage 13 into a double-cylinder structure. The upstream oxidation-passage 14 accommodates an upstream oxidation catalyst 15, on an upstream side of which the flammable-gas outlet 9 of the gas generator 3 is opened into the upstream oxidation-passage 14. Owing to this arrangement, the flammable gas of a high temperature is mixed with part of the exhaust gas 10 flowed into the upstream oxidation-passage 14, among the whole exhaust gas 10, 10 and 10 which passes through the exhaust-gas passage 13, and the mixture enters the upstream oxidation-catalyst 15. Therefore, even if the exhaust gas 10 has a low temperature, the mixture of the flammable gas 7 and the exhaust gas 10 flows into the upstream oxidation-catalyst 15 while it is maintaining a relatively high temperature to thereby secure the activation temperature of the upstream oxidation-catalyst 15 with the result of partially burning the flammable gas 7 by the upstream oxidation-catalyst 15. This combustion heat increases the temperature of the whole exhaust gas 10, 10 and 10, which flows into the oxidation catalyst 12 disposed downstream to thereby secure the activation temperature of this oxidation catalyst 12. Consequently, this oxidation catalyst 12 burns the residual flammable gas 7 to result in further increasing the temperature of the whole exhaust gas 10, 10 and 10. This exhaust gas 10 can burn the fine particles of the exhaust gas at the filter 2.

BRIEF DESCRIPTION OF THE DRAWINGS

FIG. 2(A) is a vertical sectional side view of a gas generator. FIG. 2(B) is a plan view of a guide plate and FIG. 2(C) is a top view of a partition;

FIG. 4 shows an exhaust device for a diesel engine, in accordance with a second embodiment of the present invention.

MOST PREFERRED EMBODIMENT OF THE INVENTION

Figure 1:
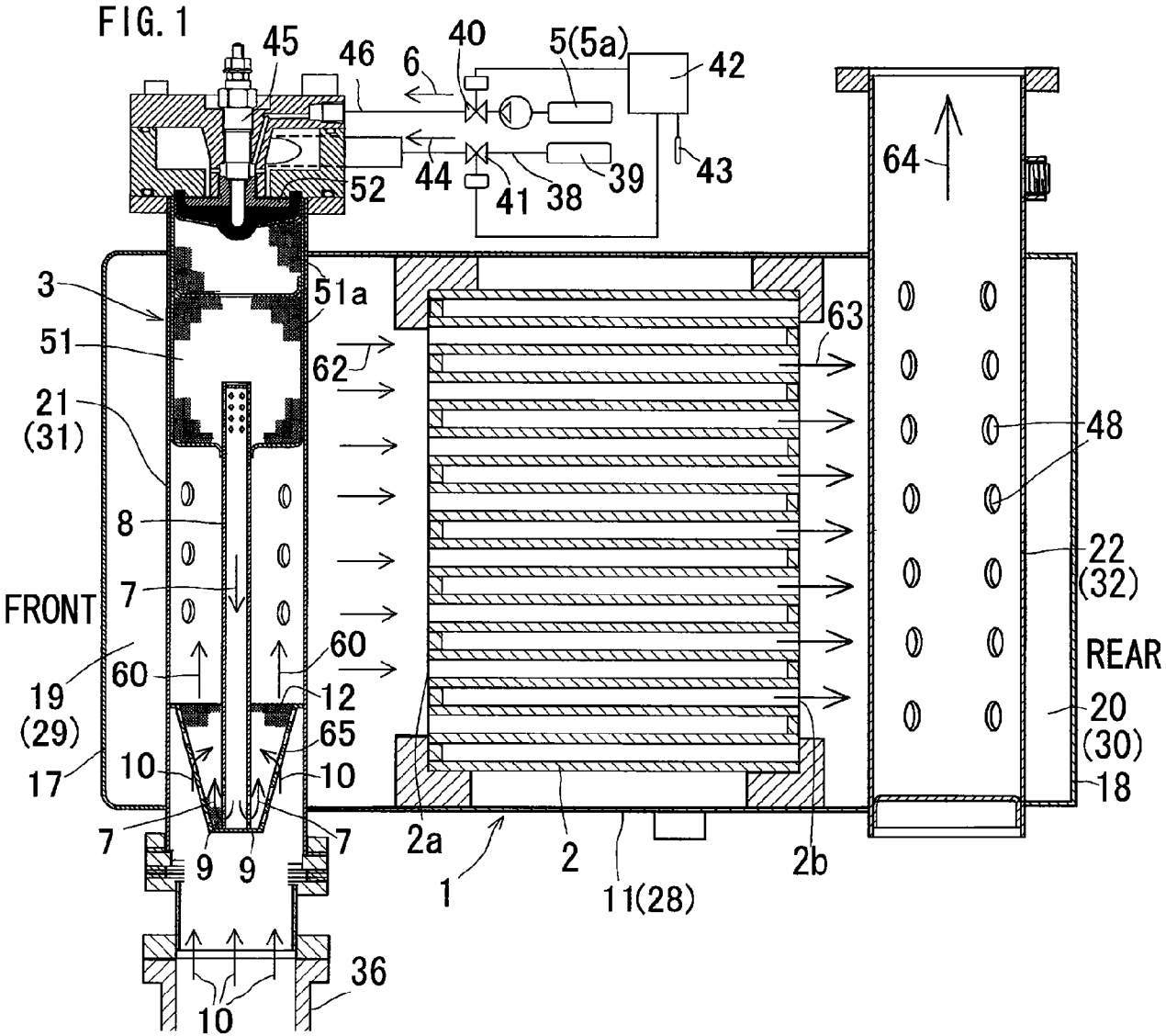
FIG. 1 is a vertical sectional side view of an exhaust device for a diesel engine, in accordance with a first embodiment of the present invention.
Figure 2:
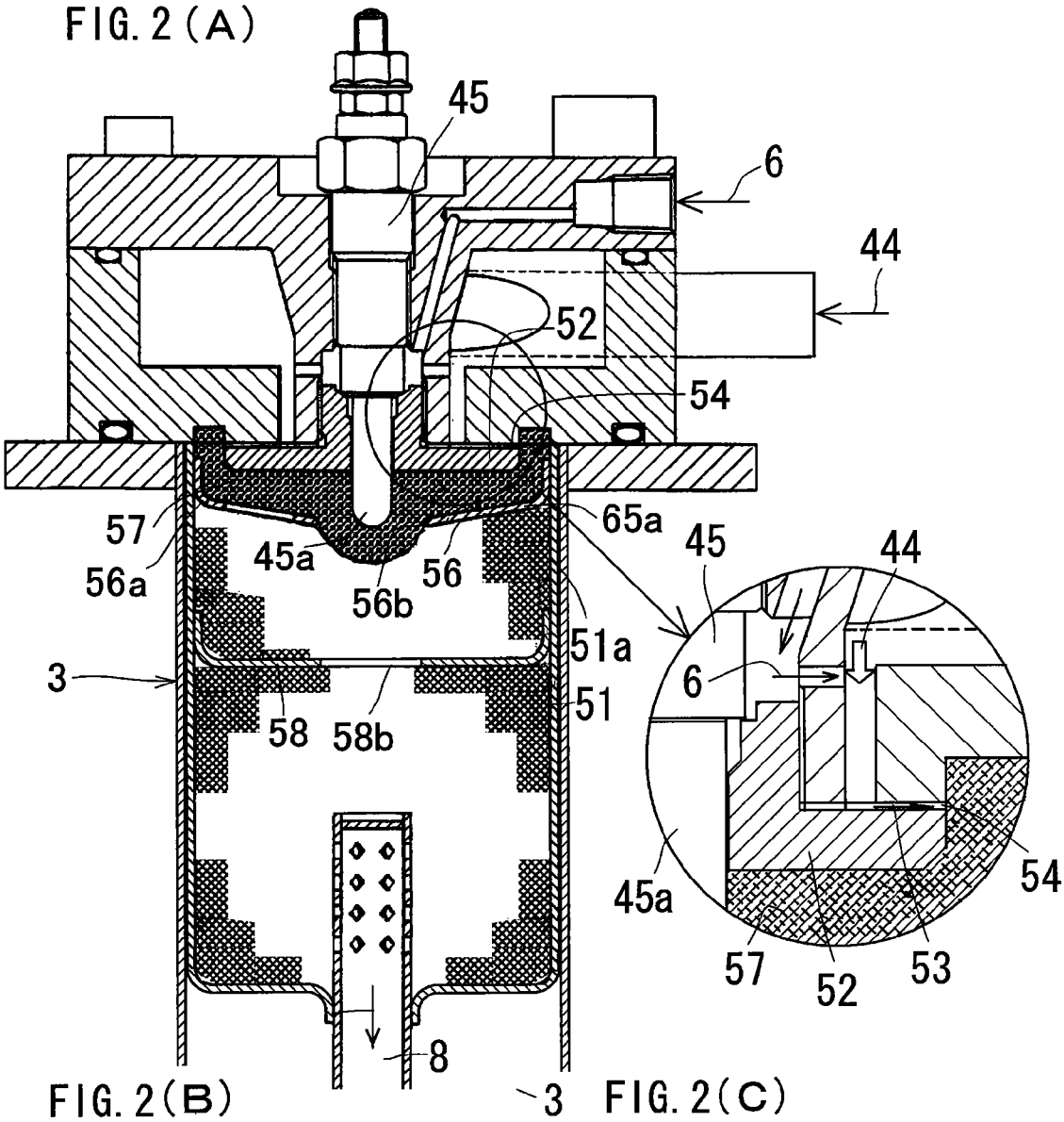
FIG. 2 shows essential portions of the exhaust device shown in FIG. 1.
Figure 2:
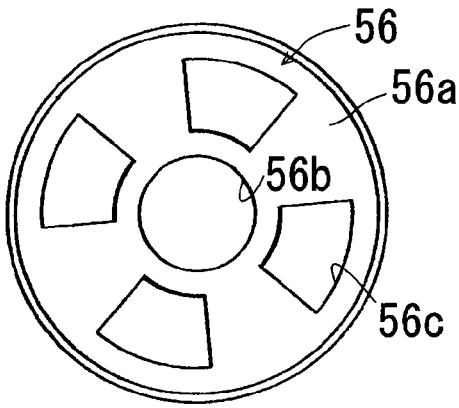
Figure 2:
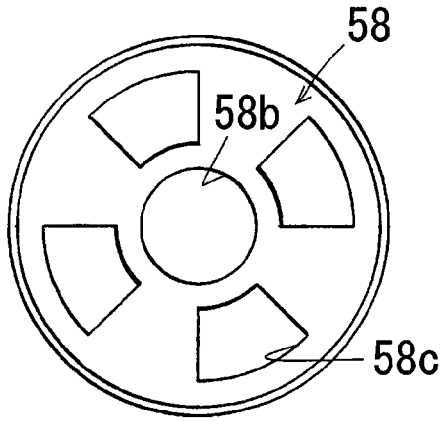
Figure 3:
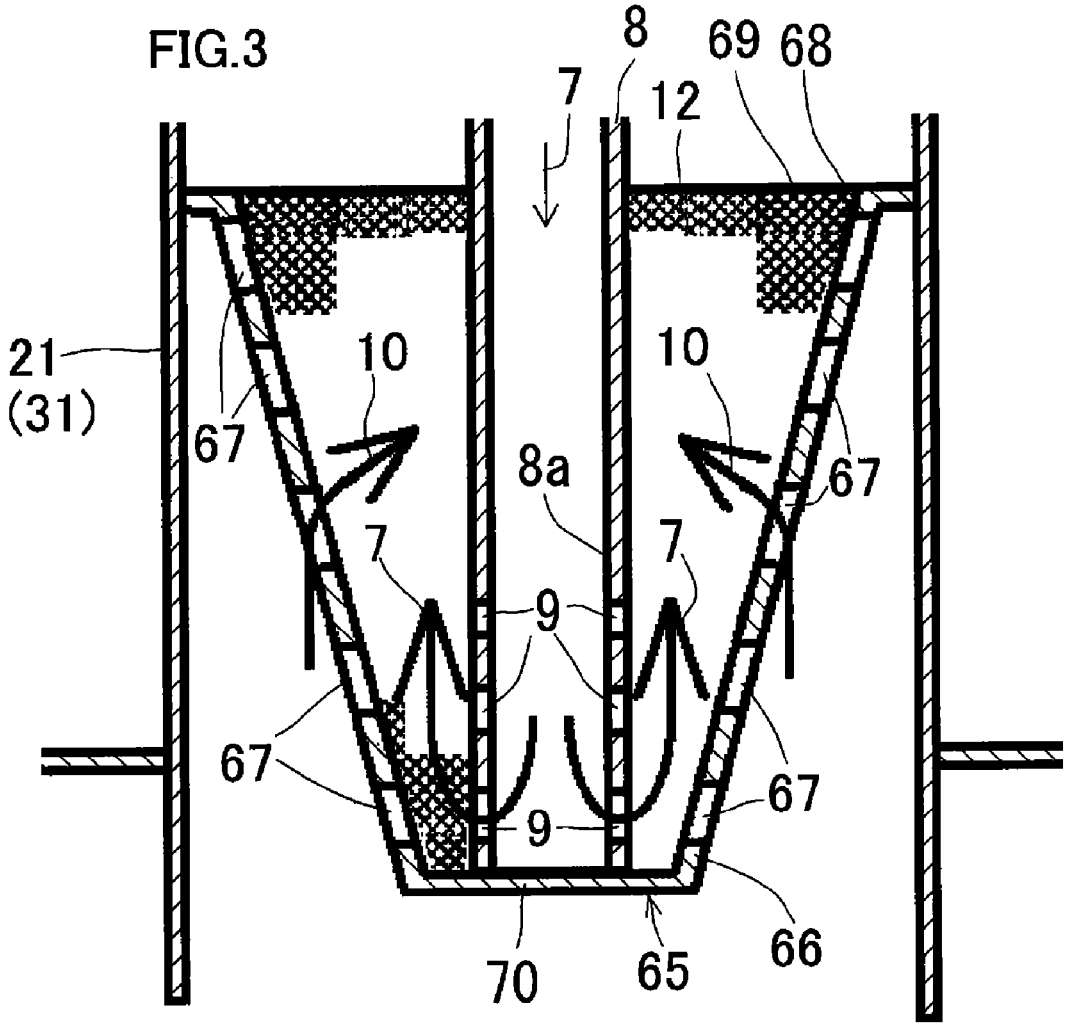
FIG. 3 is a vertical sectional side view of an oxidation catalyst to be used for the exhaust device shown in FIG. 1 and its parts positioned in the vicinity thereof.

An explanation is given for embodiments of the present invention with reference to the drawings. FIGS. 1 to 3 show an exhaust device for a diesel engine, in accordance with a first embodiment of the present invention. FIGS. 4 to 6 show an exhaust device for a diesel engine, in accordance with a second embodiment of the present invention. FIG. 7 shows an exhaust device for a diesel engine, in accordance with a third embodiment of the present invention.

The first embodiment of the present invention is outlined as follows.

As shown in FIG. 1, liquid fuel 6 is supplied from a supply source 5 of the liquid fuel 6 to a gas generator 3, which converts the liquid fuel 6 into flammable gas 7. A supply passage 8 of the flammable gas 7 is conducted out of the gas generator 3. The supply passage 8 has a flammable-gas outlet 9 which is communicated with an exhaust-gas route 1 upstream of a diesel-particulate-filter 2. The flammable gas 7 flowed out of the flammable-gas outlet 9 is burnt in exhaust gas 10 to generate combustion heat which in turn can burn fine particles of the exhaust gas 10 remaining at the filter 2. This exhaust device is connected to an exhaust-gas outlet 36 of an exhaust manifold for a diesel engine. The diesel-particulate-filter 2 is generally called as DPE and has a honeycomb structure of ceramic. An oxidation catalyst is supported on the diesel-particulate-filter 2. Alternatively, a NOx-occlusion catalyst may be supported on the filter 2. A case 11 for containing the filter 2 accommodates part of the gas generator 3.

As shown in FIG. 1, used as the liquid fuel 6 is a fuel from a fuel reservoir 5*a* of the diesel engine. When mixing the liquid fuel 6 with air 44, employed as this air 44 is air from a supercharger 39. For this purpose, a gap 53, through which the fuel passes, has an inlet side communicated with the fuel reservoir 5*a* of the diesel engine through a supply passage 46 of the liquid fuel 6 and with the supercharger 39 through an air-supply passage 38.

As illustrated in FIG. 1, the liquid-fuel supply passage 46 is provided with a liquid-fuel valve 40 and the air-supply passage 38 is provided with an air valve 41. Each of the valves 40 and 41 is associated with a back-pressure sensor 43 through a controller 42. When the filter 2 is clogged with fine particles of the exhaust gas, the back pressure increases. Then based on the detection of this increase by the back-pressure sensor 43, the controller 42 opens the liquid-fuel valve 40 and the air valve 41 so as to supply the liquid fuel 6 and the air 44 to the gas generator 3. In the gas generator 3, the liquid fuel 6 is vaporized to convert the liquid fuel 6 into flammable gas 7. This flammable gas 7 is fed into the exhaust-gas route 1. A catalyst 51*a* within a catalyst chamber 51 is an oxidation catalyst, which partially oxidizes the liquid fuel 6 to generate oxidation heat that vaporizes the remaining liquid fuel 6. Used as the catalyst 51*a* is a catalyst which comprises a catalyst component of platinum supported on a metal substrate of a cubic mesh-structure. Concretely, metal foam is used for the substrate of the catalyst 51*a*. The metal foam is a metallic porous substance having the same cubic mesh-structure as the foamed resin, the representative of which is a sponge, and is obtained by the publicly known manufacturing method. For example, it is obtained by using polyurethane foam of cubic mesh-framework as a base material; subjecting this base material to the electric-conduction treatment; then electroplating it; decomposing it by heat for removal; and leaving the metal cubic mesh-framework. As for the substrate of the catalyst 51*a*, alumina pellet or the like metal pellet may be used. The mixing ratio of the liquid fuel 6 to the air 44, namely air-fuel ratio (O/C) is set to a range of more or less than 0.6, i.e. 0.4 to 0.8.

Although, in this embodiment, the gas generator 3 vaporizes the liquid fuel 6 to convert it into the flammable gas 7, the gas generator 3 may partially oxidize the liquid fuel 6 to convert it into the flammable gas 7 containing carbon monoxide and hydrogen. In this case, as for the catalyst 51*a* within the catalyst chamber 51, a partial-oxidation catalyst is utilized instead of the oxidation catalyst. Usable as the partial-oxidation catalyst is a catalyst which comprises a catalyst component of palladium or rhodium supported on a metal substrate of a cubic mesh-structure. Alternatively, alumina pellet or the like metal pellet may be employed. The mixing ratio of the liquid fuel 6 to the air 44, namely air-fuel ratio (O/C) is set to a range of more or less than 1.3, i.e. 1.0 to 1.6.

The gas generator is constructed as follows.

As shown in FIG. 2(A), the gas generator 3 is provided with a catalyst chamber 51. In order to accommodate a catalyst 51*a* within the catalyst chamber 51, this catalyst chamber 51 has an upper portion at which a heat-conduction plate 52 is disposed. Formed along an upper surface of this heat-conduction plate 52 is a fuel-passing gap 53, to which the liquid fuel 6 and the air 44 are supplied. This fuel-passing gap 53 has a peripheral edge opened to provide a fuel outlet 54 to the catalyst chamber 51 so as to conduct the catalytic combustion heat generated within the catalyst chamber 51 through the heat-conduction plate 52 to the fuel-passing gap 53.

The catalyst chamber is constructed as follows.

As shown in FIG. 2(A), a glow plug 45 has an exothermic portion 45*a* projected downwards from a mid portion of the heat-conduction plate 52. A metal guide plate 56 is arranged below the heat-conduction plate 52 and is downwardly inclined from a peripheral edge portion 56*a* below the fuel outlet 54 to underneath the exothermic portion 45*a* of the glow plug 45, so that the liquid fuel 6 flowed out of the fuel outlet 54 is received by the peripheral edge portion 56*a* of the guide plate 56 and approaches the exothermic portion 45*a* of the glow plug 45 through the guidance of the guide plate 56. A metal flame-quenching material 57 of a cubic mesh-structure is filled into a space between the heat-conduction plate 52 and the guide plate 56. When the glow plug 45 generates heat, the heat generated by the glow plug 45 is conducted through the flame-quenching material 57 to the heat-conduction plate 52 and the guide plate 56. During the combustion of the catalyst 51*a* within the catalyst chamber 51, the catalytic combustion heat is conducted through the guide plate 56 and the flame-quenching material 57 to the heat-conduction plate 52. The glow plug 45 is associated with the controller 42 so as to generate heat for a predetermined period of time at the initial term of the gas generation. Metal foam is used for the flame-quenching material 57, but an agent made of stainless steel, generally called as 'wire-mesh', may be used.

As shown in FIG. 2(A), the guide plate 56 has an under surface with which the catalyst 51*a* within the catalyst chamber 51 is brought into contact. A catalyst component is supported on the flame-quenching material 57. When the glow plug 45 generates heat, the heat generated by the glow plug 45 is conducted through the heat-conduction plate 52 to the fuel-passing gap 53. Platinum of an oxidation-catalyst component is supported on the flame-quenching material 57. There is disposed below the guide plate 56 a partition 58, which divides the interior area of the catalyst chamber 51. As shown in FIGS. 2(B) and 2(C), each of the guide plate 56 and the partition 58 is opened to provide a center hole 56*b* and a center hole 58*b*, respectively. A plurality of peripheral holes 56*c* are provided while being peripherally spaced at a predetermined interval around the central hole 56*b* and a plurality of peripheral holes 58*c* are formed while being peripherally spaced at a predetermined interval around the central hole 58*b*. The respective peripheral holes 56*c* and 58*c* of the guide plate 56 and the partition 58 are mutually staggered, when seen from above, so that the liquid fuel 6 flowed out of the fuel outlet 54 is prevented from straightly flowing down through the peripheral holes 56*c* and the peripheral holes 58*c* in the mentioned order. Both of the guide plate 56 and the partition 58 are made of stainless steel.

As shown in FIG. 1, an oxidation catalyst 12 for accelerating the combustion of the flammable gas 7 is arranged between a flammable-gas outlet 9 and an inlet 2*a* of the filter 2. The oxidation catalyst 12 is composed as follows.

As shown in FIG. 3, in order to flow the flammable gas 7 heated by the exothermic reaction within the gas generator 3 out of the flammable-gas outlet 9 to the oxidation catalyst 12, the oxidation catalyst 12 is filled within a case 65 for accommodating the oxidation catalyst 12 and the flammable-gas outlet 9 is opened into the oxidation catalyst 12. The oxidation-catalyst accommodating case 65 has a peripheral wall 66 provided with a plurality of exhaust-gas inlets 67 and has a terminal end portion 68 formed with an exhaust-gas outlet 69. The flammable-gas outlet 9 is provided in plural number. These plural flammable-gas outlets 9 are arranged side by side longitudinally of the terminal end portion 8*a* of the flammable-gas supply passage 8. A number of exhaust-gas inlets 67 are disposed in the peripheral wall 66 of the oxidation-catalyst accommodating case 65.

As shown in FIG. 3, when arranging the exhaust-gas inlets 67 side by side in the peripheral wall 66 of the oxidation-catalyst accommodating case 65 from the beginning end portion 70 of the case 65 to the terminal end portion 68 thereof, the peripheral wall 66 of the oxidation-catalyst accommodating case 65 has a diameter progressively increased from the beginning end portion 70 to the terminal end portion 68. The oxidation-catalyst accommodating case 65 forms a cup of a truncated cone. Used as the oxidation catalyst 12 is a catalyst which comprises a catalyst component supported on a metal substrate of a cubic mesh-structure. Metal foam is utilized for the substrate of the oxidation catalyst 12. As for the substrate of the catalyst 12, the substrate made of stainless steel and generally called as "wire-mesh" may be used.

The filter-containing case has the following concrete structure.

As shown in FIG. 1, a cylindrical filter-containing case 11 provided with end walls 17 and 18 at its both ends is used as the filter-containing case. An axial direction of this filter-containing case 11 is taken as a front and rear direction. A side of an inlet 2*a* of the filer 2 is determined as 'front' and a side of an outlet 2*b* is defined as 'rear'. Within the filter-containing case 11, an exhaust-gas inlet chamber 19 is disposed in front of the filter 2 and an exhaust-gas outlet chamber 20 is arranged at the rear of the filter 2.

The exhaust-gas inlet chamber 19 is communicated with an exhaust-gas inlet pipe 21 and the exhaust-gas outlet chamber 20 is communicated with an exhaust gas outlet pipe 22.

The exhaust-gas inlet pipe 21 is inserted into the exhaust-gas inlet chamber 19 along a radial direction of the filter-containing case 11. The oxidation catalyst 12 and part of the gas generator 3 are arranged from the upstream side of the exhaust gas into the exhaust-gas inlet pipe 21 in the mentioned order. And the flammable-gas supply passage 8 led out of the gas generator 3 is inserted into the oxidation catalyst 12.

An exhaust muffler 28 is utilized as the filter-containing case 11. The exhaust-gas inlet chamber 19 is composed of a first expansion chamber 29 and the exhaust-gas outlet chamber 20 is constructed by a final expansion chamber 30. The exhaust-gas inlet pipe 21 is formed from an exhaust-gas lead-in pipe 31 of the first expansion chamber 29 and the exhaust-gas outlet pipe 22 is composed of an exhaust-gas lead-out pipe 32 of the final expansion chamber 30.

The flammable gas generates and functions as follows.

As shown in FIG. 2(A), when the gas generator 3 is supplied with the liquid fuel 6 and with the air 44, the liquid fuel 6 mixes with the air 44 within the fuel-passing gap 53. The liquid fuel 6 is converted into fine particles, which flow from the fuel-passing gap 53 through the flame-quenching material 57 into the catalyst chamber 51. Part of this liquid fuel 6 is oxidized (makes catalytic combustion) within the catalyst chamber 51 to generate oxidation (combustion) heat with which the remaining liquid fuel 6 is vaporized to become high-temperature flammable gas 7. This high-temperature flammable gas 7, as shown in FIG. 2(A), is fed from the flammable-gas supply passage 8 into the oxidation catalyst 12. On the other hand, the exhaust gas 10 which passes through the exhaust-gas route 1 flows into the oxidation catalyst 12 and is mixed with the high-temperature flammable gas 7 and the mixture passes through the oxidation catalyst 12. The flammable gas 7 is oxidized (burnt) by the oxygen contained in the mixed exhaust gas 10 to produce oxidation heat (combustion heat) which heats the mixed exhaust gas 10.

As shown in FIG. 1, the exhaust gas 10 flows out of the oxidation catalyst 12 as shown by arrows 60 and further flows out of the outlet holes 47 of the exhaust-gas lead-in pipe 31 into the first expansion chamber 29. Then as shown by arrows 62, it enters the filter 2 from the inlets 2*a* and passes therethrough. The exhaust gas 10 that has passed through the filter 2 flows from the outlets 2*b* of the filter 2 into the final expansion chamber 30 as shown by arrows 63. Thereafter, it flows from the inlet holes 48 of the exhaust-gas lead-in pipe 32 into the exhaust-gas lead-in pipe 32 and flows out of the exhaust-gas lead-out pipe 32 as shown by an arrow 64.

The second embodiment as shown in FIGS. 4 to 6 is different from the first embodiment on the following points.

Figures 4A, 4B:
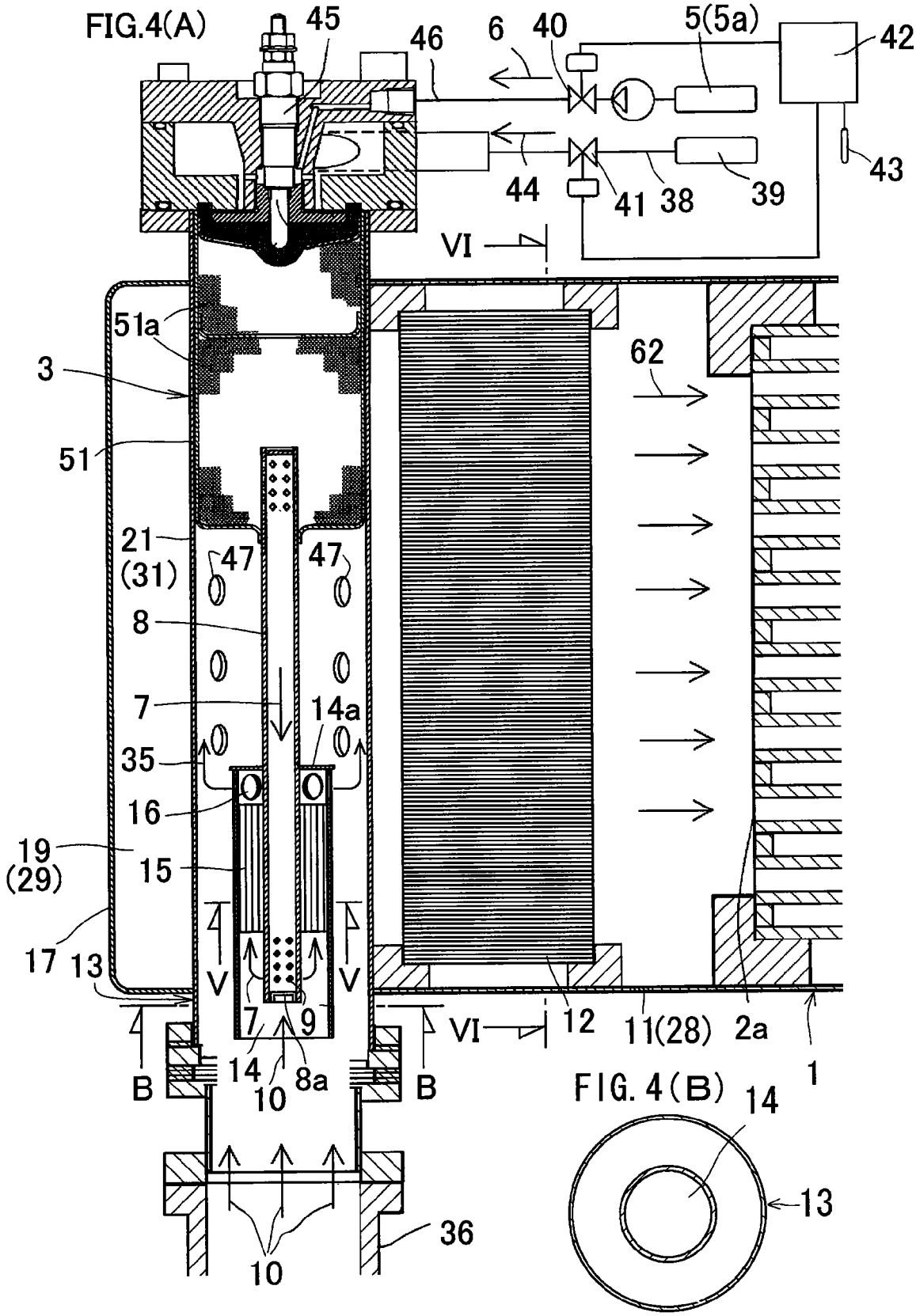
FIG. 4(A) is a vertical sectional side view of a front portion and FIG. 4(B) is a sectional view taken along a line B-B in FIG. 4(A)

As shown in FIG. 4(A), the oxidation catalyst 12 is arranged outside the exhaust-gas inlet pipe 31, although it exists within the filter-containing case 11. In order to flow the flammable gas 7 heated by the exothermic reaction within the gas generator 3 from the flammable-gas outlet 9 to the upstream side of the oxidation catalyst 12, an upstream oxidation-passage 14 is formed within the exhaust-gas passage 13 upstream of the oxidation catalyst 12 and is formed into a double-cylinder structure. The upstream oxidation-passage 14 accommodates an upstream oxidation-catalyst 15, on an upstream side of which the flammable-gas outlet 9 is opened toward the upstream oxidation-passage 14. The exhaust-gas passage 13 is the exhaust-gas inlet pipe 21.

The upstream oxidation-passage has a sectional area set as follows.

As shown in FIG. 4(B), the upstream oxidation-passage 14 of the exhaust-gas passage 13 of the double-cylinder structure has a sectional area set to one fourth (¼) of the sectional area of the whole exhaust-gas passage 13 including the upstream oxidation-passage 14. In order to assuredly attain the oxidation-acceleration function of the upstream oxidation-catalyst 15, it is desirable to set the sectional area of the upstream oxidation-passage 14 of the exhaust-gas passage 13 of double-cylinder structure within a range of ¼ to ½ of the total sectional area of the exhaust-gas passage 13 including the upstream oxidation passage 14.

The flammable-gas outlet and the upstream oxidation-passage are opened in the following direction.

As shown in FIG. 4(A), the flammable-gas lead-out pipe 8 oriented in the direction where the upstream oxidation-passage 14 is formed has its terminal end 8*a* closed and has a peripheral wall near the terminal end 8*a* opened to provide the plurality of flammable-gas outlets 9 oriented radially of the upstream oxidation-passage 14. Further, the upstream oxidation-passage 14 has its terminal end 14*a* closed and has a peripheral wall near the terminal end 14*a*, opened to form a plurality of upstream oxidation-passage outlets 16 oriented radially of a passage 4 in front of the oxidation-catalyst inlet.

The flammable gas generates and functions as follows.

As shown in FIG. 4(A), the high-temperature flammable gas 7 is fed from the flammable-gas supply passage 8 to the upstream oxidation-passage 14 within the exhaust-gas passage 13. On the other hand, part 10 of the exhaust gas 10, 10 and 10 which passes through the exhaust-gas passage 13 flows into the upstream oxidation-passage 14 and is mixed with the high-temperature flammable gas 7 and the mixture passes through the upstream oxidation-catalyst 15. The flammable gas 7 is oxidized (burnt) by the oxygen contained in the mixed exhaust gas 10 to produce oxidation heat (combustion heat) which heats the mixed exhaust gas 10. The heated exhaust gas 10 flows out of the upstream oxidation-passage outlet 16 as shown by arrows 35 and is mixed with the remaining exhaust gas 10 and 10 which did not flow into the upstream oxidation-passage 14. The mixture flows out of the outlet holes 47 and passes through the oxidation catalyst 12. The flammable gas 7 oxidized (burnt) by the upstream oxidation-catalyst 15 and remaining is oxidized (burnt) by the oxygen in the mixed exhaust gas 10 to produce oxidation (combustion) heat with which the mixed exhaust gas 10 is heated.

The upstream oxidation-catalyst comprises as follows.

Figure 5A:
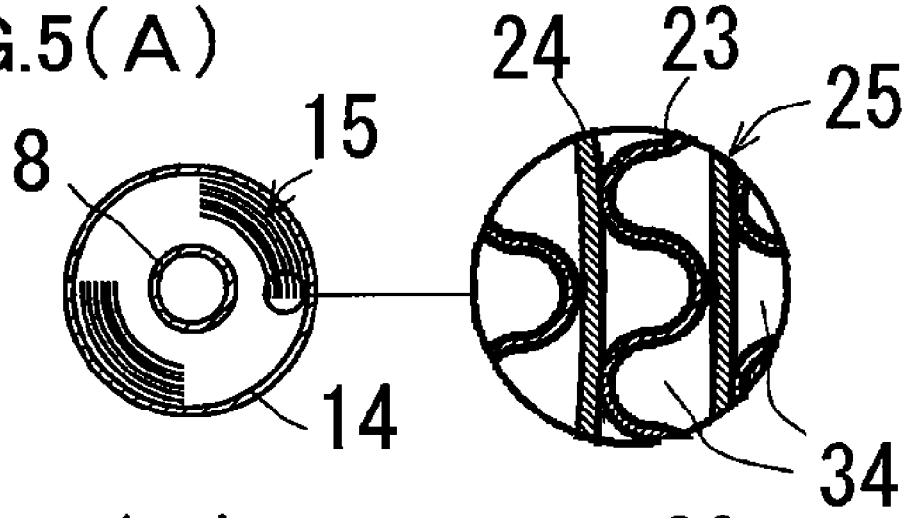
FIG. 5(A) is a sectional view taken along a line V-V in FIG. 4(A) and FIG. 5(B) corresponds to FIG. 5(A) of a modification.
Figure 6A:
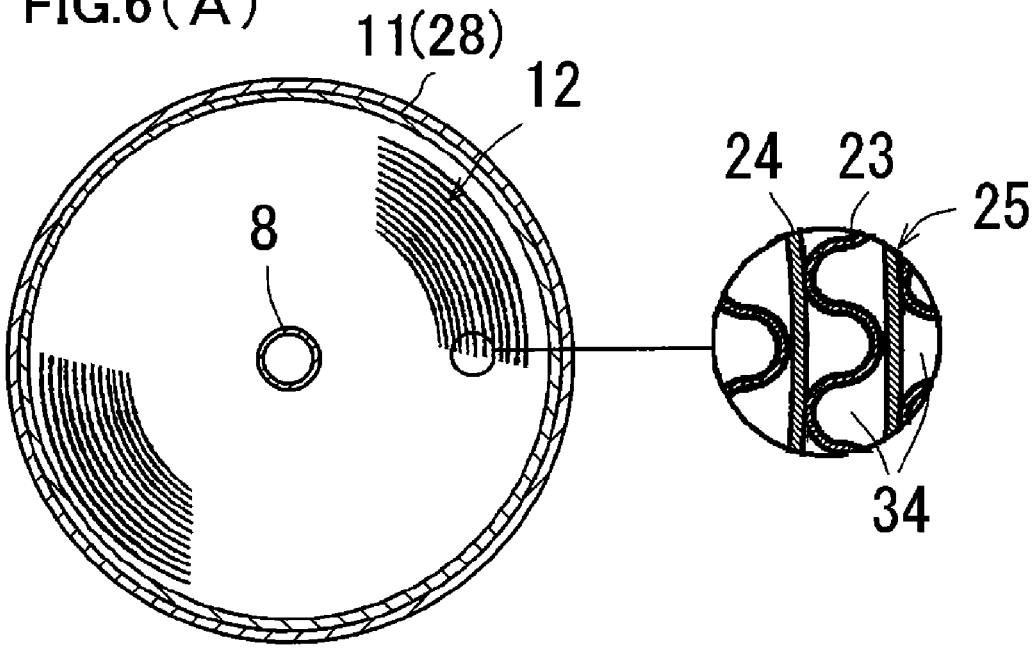
FIG. 6(A) is a sectional view taken along a line VI-VI of FIG. 4(A) and FIG. 6(B) corresponds to FIG. 6(A) of the modification.

As shown in FIG. 5(A), used as the upstream oxidation catalyst 15 is a catalyst which comprises a catalyst component supported on a substrate 25 formed by overlaying and winding a corrugated metal sheet 23 and a flat metal sheet 24. Each of the metal sheets 23 and 24 is a stainless steel sheet having a thickness of 0.5 mm. Platinum is used as the catalyst component. In the case where the upstream oxidation-catalyst 15 has such a structure, a relatively wide inter-catalyst passage 34 is formed and therefore even the upstream oxidation-passage 14 of a smaller diameter assures a sufficient sectional area of the inter-catalyst passage within the upstream oxidation-catalyst 15. Additionally, since the substrate itself 25 is resilient, it can be retained within the upstream oxidation-passage 14 without using any cushion material.

Figure 5B:
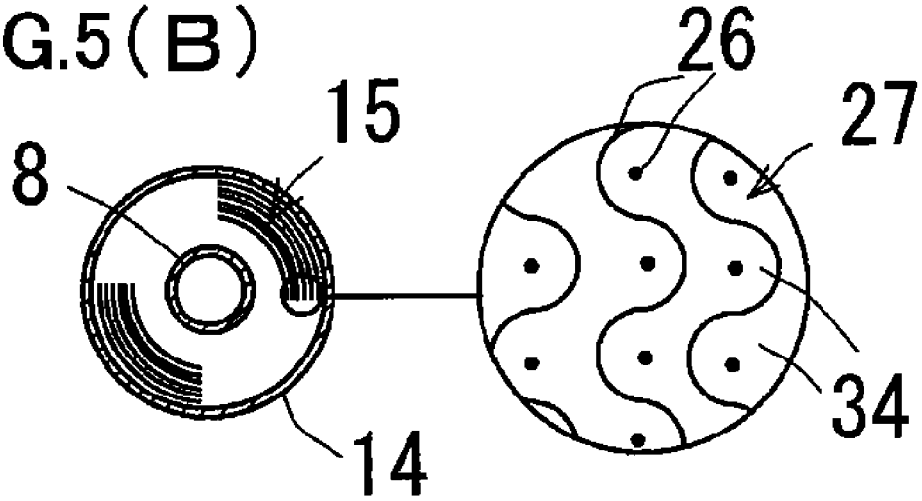
FIG. 5 shows an upstream oxidation-catalyst to be used for the exhaust device in FIG. 4.

As shown in FIG. 5(B), as for the upstream oxidation-catalyst 15, it is possible to use a catalyst which comprises a catalyst component supported on a substrate 27 formed from a metal mesh 26. This metal mesh 26 is made of stainless steel and is generally called as "wire-mesh". Platinum is used as the catalyst component. Also in this case, the same function as that of FIG. 5(A) can be obtained.

The oxidation catalyst is composed as follows.

As shown in FIG. 6 (A), used as the oxidation catalyst 12 is a catalyst which comprises a catalyst component supported on a substrate 25 formed by overlaying and winding a corrugated metal sheet 23 and a flat metal sheet 24. Each of the metal sheets 23 and 24 is a stainless steel sheet having a thickness of 0.5 mm. Platinum is used as the catalyst component. In the case where the oxidation catalyst 12 has such a structure, a relatively wide inter-catalyst passage 34 is formed and therefore a sufficient sectional area of the inter-catalyst passage within the oxidation catalyst 12 is assured. Additionally, since the substrate 25 itself is resilient, it can be retained within the filter-containing case 11 without using any cushion material.

Figure 6B:
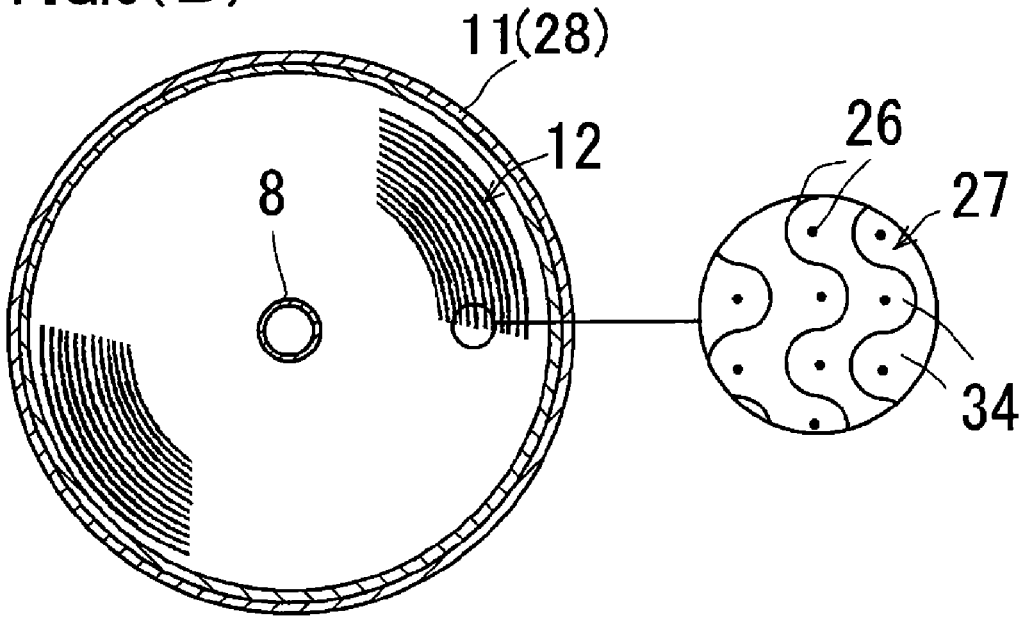
FIG. 6 is an oxidation catalyst to be used for the exhaust device in FIG. 4.
Figure 7:
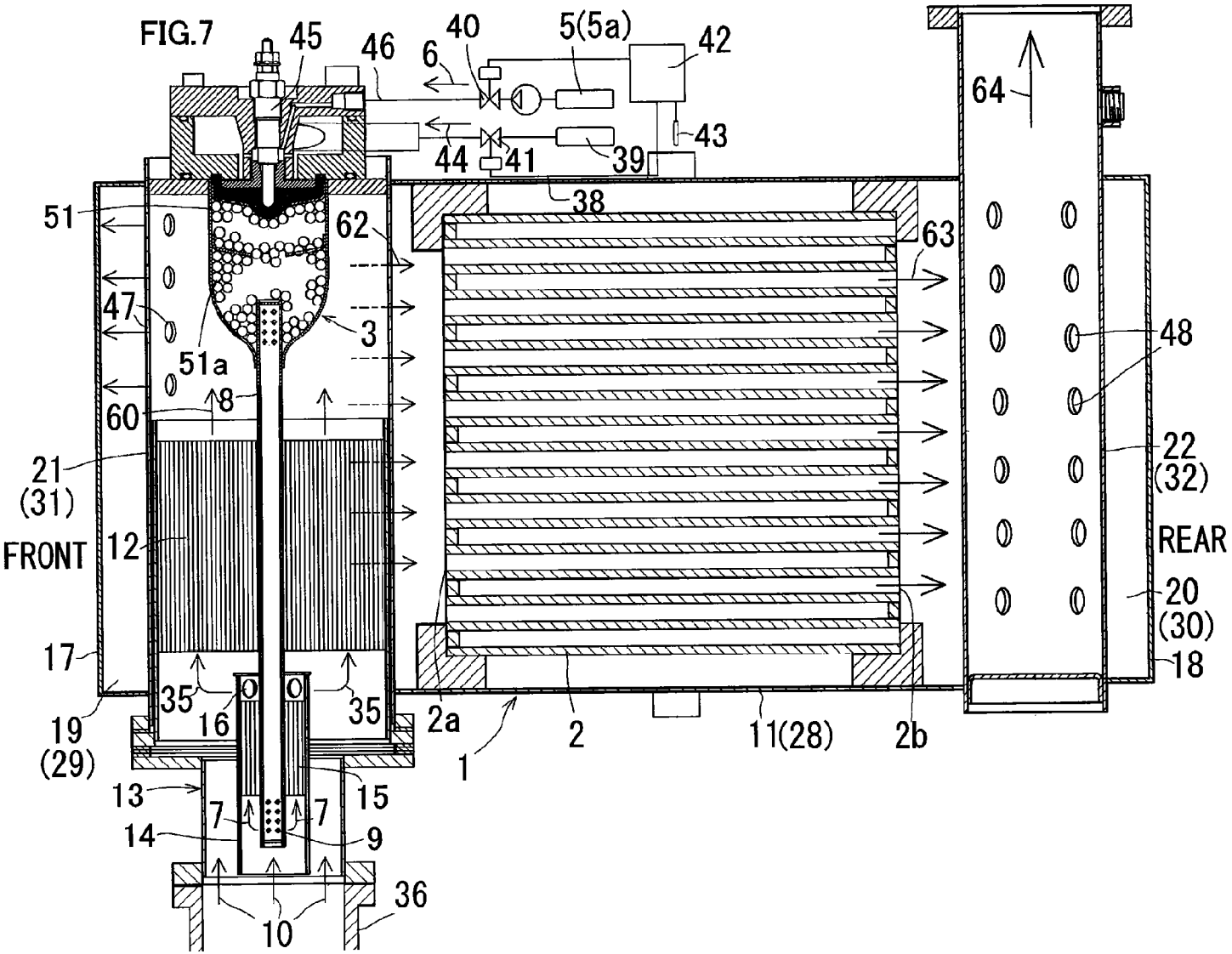
FIG. 7 is a vertical sectional view of an exhaust device for a diesel engine, in accordance with a third embodiment of the present invention.

As shown in FIG. 6(B), as for the oxidation catalyst 12, it is possible to use a catalyst which comprises a catalyst component supported on a substrate 27 formed from a metal mesh 26. This metal mesh 26 is made of stainless steel and is generally called as "wire-mesh". Platinum is used as the catalyst component. Also in this case, the same function as that of FIG. 6(A) can be attained.

The second embodiment is the same as the first embodiment except for the other constructions and functions. In FIGS. 4 to 6, the same elements as those in the first embodiment are indicated by the same numerals as those of FIGS. 1 to 3.

The third embodiment shown in FIG. 7 is distinct from the first embodiment on the following point.

Alumina pellet is used for the substrate of the catalyst 51*a* within the catalyst chamber 51. The oxidation catalyst 12 is accommodated between the upstream oxidation catalyst 15 and the catalyst chamber 51 of the gas generator 3 within the exhaust-gas inlet pipe 21 of the filter-containing case 11. The flammable-gas lead-out passage 8 extends through the oxidation catalyst 12. The third embodiment is the same as the second embodiment except for the other constructions and functions. In FIG. 7, the same elements as those of the second embodiment and of the first embodiment are designated by the same numerals of FIG. 4 and those of FIGS. 1 to 3.

What we claim is:

1. An exhaust device for a diesel engine, that supplies liquid fuel (6) from a supply source (5) of the liquid fuel (6) to a gas generator (3) which converts the liquid fuel (6) to flammable gas (7) and from which a flammable-gas supply passage (8) is conducted, the flammable-gas supply passage (8) having a flammable-gas outlet (9) communicated with an exhaust-gas route (1) upstream of a diesel-particulate-filter (2), the flammable gas (7) flowed out of the flammable-gas outlet (9) being burnt in exhaust gas (10) to generate combustion heat which can burn fine particles of the exhaust gas (10) remaining at the filter (2), wherein a case (11) for containing the filter (2) accommodates at least part of the gas generator (3), when providing the gas generator (3) with a catalyst chamber (51), within which a catalyst (51*a*) is accommodated, a heat-conduction plate (52) is arranged at an upper portion of the catalyst chamber (51) and a fuel-passing gap (53) is formed along an upper surface of the heat-conduction plate (52), the fuel-passing gap (53) being supplied with the liquid fuel (6) and with the air (44) and having a peripheral edge opened to provide a fuel outlet (54) to the catalyst chamber (51), catalytic combustion heat generated within the catalyst chamber (15) is conducted through the heat-conduction plate (52) to the fuel-passing gap (53), and the heat conduction-plate (52) has a mid portion from which an exothermic portion (45*a*) of a glow plug (45) projects downwards, and a metal guide plate (56) is arranged below the heat-conduction plate (52), the guide plate (56) being downwardly inclined from a peripheral edge portion (56*a*) underneath the fuel outlet (54) to below an exothermic portion (45*a*) of the glow plug (45), thereby receiving the liquid fuel (6) flowed out of the fuel outlet (54) by the peripheral edge portion (56*a*) of the guide plate (56) to guide it by the guide plate (56) so as to approach the exothermic portion (45*a*) of the glow plug (45).

2. The exhaust device for a diesel engine as set forth in claim 1, wherein fuel from a fuel reservoir (5*a*) of the diesel engine is used as the liquid fuel (6) and when mixing air (44) into the liquid fuel (6), used as this air (44) is the air from a supercharger (39).

3. The exhaust device for a diesel engine as set forth in claim 1, wherein when the glow plug (45) generates heat, the heat generated by the glow plug (45) is conducted through the heat-conduction plate (52) to the fuel-passing gap (53).

4. The exhaust device for a diesel engine as set forth in claim 1, wherein the gas generator (3) vaporizes the liquid fuel (6) to convert it into the flammable gas (7).

5. The exhaust device for a diesel engine as set forth in claim 1, wherein the gas generator (3) partially oxidizes the liquid fuel (6) to convert it into flammable gas (7) containing carbon monoxide and hydrogen.

6. The exhaust device for a diesel engine as set forth in claim 1, wherein a metal flame-quenching material (57) of a cubic mesh-structure is filled into a space between the heat-conduction plate (52) and the guide plate (56), when the glow plug (45) generates heat, the heat generated by the glow plug (45) is conducted through the flame-quenching material (57) to the heat-conduction plate (52) and the guide plate (56), and during the catalytic combustion within the catalyst chamber (51), the generated catalytic combustion heat is conducted through the guide plate (56) and the flame-quenching material (57) to the heat-conduction plate (52).

7. The exhaust device for a diesel engine as set forth in claim 6, wherein the guide plate (56) has an under surface with which the catalyst (51*a*) within the catalyst chamber (51) is brought into contact.

8. The exhaust device for a diesel engine as set forth in claim 6, wherein a catalyst component is supported on the flame-quenching material (57).

9. An exhaust device for a diesel engine, that supplies liquid fuel (6) from a supply source (5) of the liquid fuel (6) to a gas generator (3) which converts the liquid fuel (6) to flammable gas (7) and from which a flammable-gas supply passage (8) is conducted, the flammable-gas supply passage (8) having a flammable-gas outlet (9) communicated with an exhaust-gas route (1) upstream of a diesel-particulate-filter (2), the flammable gas (7) flowed out of the flammable-gas outlet (9) being burnt in exhaust gas (10) to generate combustion heat which can burn fine particles of the exhaust gas (10) remaining at the filter (2), wherein a case (11) for containing the filter (2) accommodates at least part of the gas generator (3), an oxidation catalyst (12) for accelerating the combustion of the flammable gas (7) is disposed between the flammable-gas outlet (9) and an inlet (2*a*) of the filter (2), in order to flow the flammable gas (7) heated by the exothermic reaction within the gas generator (3) from the flammable-gas outlet (9) to the oxidation catalyst (12), the oxidation catalyst (12) is filled within an oxidation-catalyst accommodating case (65) and the flammable-gas outlet (9) is opened into the oxidation catalyst (12), the oxidation-catalyst accommodating case (65) having a peripheral wall (66) provided with a plurality of exhaust-gas inlets (67) and having a terminal end portion (68) provided with an exhaust-gas outlet (69), and when arranging the exhaust-gas inlets (67) side by side in the peripheral wall (66) of the oxidation-catalyst accommodating case (65) from a beginning end portion (70) of the case (65) toward a terminal end portion (68) thereof, the peripheral wall (66) of the oxidation-catalyst accommodating case (65) is progressively increasing in its diameter from the beginning end portion (70) toward the terminal end portion (68).

10. The exhaust device for a diesel engine as set forth in claim 9, wherein employed as the oxidation catalyst (12) is a catalyst which comprises a catalyst component supported on a metal substrate of a cubic mesh-structure.

11. An exhaust device for a diesel engine, that supplies liquid fuel (6) from a supply source (5) of the liquid fuel (6) to a gas generator (3) which converts the liquid fuel (6) to flammable gas (7) and from which a flammable-gas supply passage (8) is conducted, the flammable-gas supply passage (8) having a flammable-gas outlet (9) communicated with an exhaust-gas route (1) upstream of a diesel-particulate-filter (2), the flammable gas (7) flowed out of the flammable-gas outlet (9) being burnt in exhaust gas (10) to generate combustion heat which can burn fine particles of the exhaust gas (10) remaining at the filter (2), wherein a case (11) for containing the filter (2) accommodates at least part of the gas generator (3), an oxidation catalyst (12) for accelerating the combustion of the flammable gas (7) is disposed between the flammable-gas outlet (9) and an inlet (2*a*) of the filter (2), a cylindrical filter-containing case (11) having end walls (17) and (18) at its both ends is utilized, an axial direction of this filter-containing case (11) being taken as a front and rear direction, a side of the inlet (2*a*) of the filter (2) being determined as 'front' and a side of an outlet (2*b*) being defined as 'rear', an exhaust-gas inlet chamber (19) being provided in front of the filter (2) and an exhaust-gas outlet chamber (20) being provided at the rear of the filter (2) within the filter-containing case (11), an exhaust-gas inlet pipe (21) being communicated with the exhaust-gas inlet chamber (19) and an exhaust-gas outlet pipe (22) being communicated with the exhaust-gas outlet chamber (20), and the exhaust-gas inlet pipe (21) is inserted into the exhaust-gas inlet chamber (19) along a radial direction of the filter-containing case (11), within the exhaust-gas inlet pipe (21) the oxidation catalyst (12) and at least part of the gas generator (3) are arranged in the mentioned order from the upstream side of the exhaust gas, the flammable-gas supply passage (8) led out of the gas generator (3) being inserted into the oxidation catalyst (12).

12. The exhaust device for a diesel engine as set forth in claim 11, wherein an exhaust muffler (28) is used as the filter-containing case (11) and the exhaust-gas inlet chamber (19) is formed from a first expansion chamber (29), the exhaust-gas outlet chamber (20) being composed of a final expansion chamber (30), the exhaust-gas inlet pipe (21) being formed from an exhaust-gas lead-in pipe (31) of the first expansion chamber (29), the exhaust-gas outlet pipe (22) being composed of an exhaust-gas lead-out pipe (32) of the final expansion chamber (30).

13. An exhaust device for a diesel engine, that supplies liquid fuel (6) from a supply source (5) of the liquid fuel (6) to a gas generator (3) which converts the liquid fuel (6) to flammable gas (7) and from which a flammable-gas supply passage (8) is conducted, the flammable-gas supply passage (8) having a flammable-gas outlet (9) communicated with an exhaust-gas route (1) upstream of a diesel-particulate-filter (2), the flammable gas (7) flowed out of the flammable-gas outlet (9) being burnt in exhaust gas (10) to generate combustion heat which can burn fine particles of the exhaust gas (10) remaining at the filter (2), wherein a case (11) for containing the filter (2) accommodates at least part of the gas generator (3), an oxidation catalyst (12) for accelerating the combustion of the flammable gas (7) is disposed between the flammable-gas outlet (9) and an inlet (2*a*) of the filter (2), and in order to flow the flammable gas (7) heated by the exothermic reaction within the gas generator (3) from the flammable-gas outlet (9) to the upstream side of the oxidation catalyst (12), an upstream oxidation-passage (14) is formed upstream of the oxidation catalyst (12) within an exhaust-gas passage (13), which is formed into a double-cylinder structure, and an upstream oxidation-catalyst (15) is accommodated within the upstream oxidation-passage (14), the flammable-gas outlet (9) being opened into the upstream oxidation-passage (14) on an upstream side of the upstream oxidation-catalyst (15).

* * * * *